US006889873B1

(12) United States Patent
Leboucher

(10) Patent No.: US 6,889,873 B1
(45) Date of Patent: May 10, 2005

(54) POUCH AND PACKAGING AND DISTRIBUTION UNIT

(75) Inventor: Xavier Leboucher, Clichy (FR)

(73) Assignee: VG Emballage, Paris (FR)

( * ) Notice: Subject to any disclaimer, the term of this patent is extended or adjusted under 35 U.S.C. 154(b) by 0 days.

(21) Appl. No.: 09/926,235

(22) PCT Filed: Feb. 9, 2000

(86) PCT No.: PCT/FR00/00304

§ 371 (c)(1),
(2), (4) Date: Jun. 3, 2002

(87) PCT Pub. No.: WO00/58021

PCT Pub. Date: Oct. 5, 2000

(30) Foreign Application Priority Data

Mar. 30, 1999 (FR) ..... 99 03966

(51) Int. Cl.[7] ..... B65D 35/056
(52) U.S. Cl. ..... 222/105; 222/94; 222/145.3
(58) Field of Search ..... 222/94, 95, 105, 222/321.7, 145.3

(56) References Cited

U.S. PATENT DOCUMENTS 3,070,265 A * 12/1962 Everett ..... 222/386.5
3,140,802 A * 7/1964 Everett ..... 222/386.5
4,089,443 A * 5/1978 Zrinyi ..... 222/386.5
4,469,250 A * 9/1984 Evezich ..... 222/83.5
4,909,416 A * 3/1990 Evezich ..... 222/95
5,312,018 A * 5/1994 Evezich ..... 222/95
5,454,486 A * 10/1995 Mack et al. ..... 222/95
5,813,571 A * 9/1998 Gaucher ..... 222/95
6,305,577 B1 * 10/2001 Fillmore et al. ..... 222/95
6,308,862 B1 * 10/2001 Fillmore et al. ..... 222/94

FOREIGN PATENT DOCUMENTS

| | | |
|---|---|---|
| EP | 0 622 311 | 11/1994 |
| FR | 2 641 337 | 7/1990 |
| FR | 2 669 306 | 5/1992 |

* cited by examiner

*Primary Examiner*—Melvin Cartagena
(74) *Attorney, Agent, or Firm*—Oblon, Spivak, McClelland, Maier & Neustadt, P.C.

(57) ABSTRACT

The invention relates to a pouch that is provided with a deformable flexible wall and designed to contain a liquid/pasty product that is distributed by a manual recirculating metering jet pump disposed on an opening zone of said-pouch and able to be fitted in such a way that it cooperates with the latter to ensure that the product thus contained can be permanently stored without contact with the air. The pouch is equipped with a pump and can be introduced into and protected by an outer casing in order to form a packaging and distribution unit for said product. The pouch (1) has at least one rigid area in the vicinity of the opening thereof. Said area is created by a thickening of said wall and comprises fixing means (6, 7, 8; 10) in addition to means (13) that can be borne by the pump or by an element that is associated with the latter in the unit when in a mounted state and/or by said outer casing (12) when it is present or by one of the parts of said casing.

15 Claims, 4 Drawing Sheets

POUCH AND PACKAGING AND DISTRIBUTION UNIT

Figure 1:
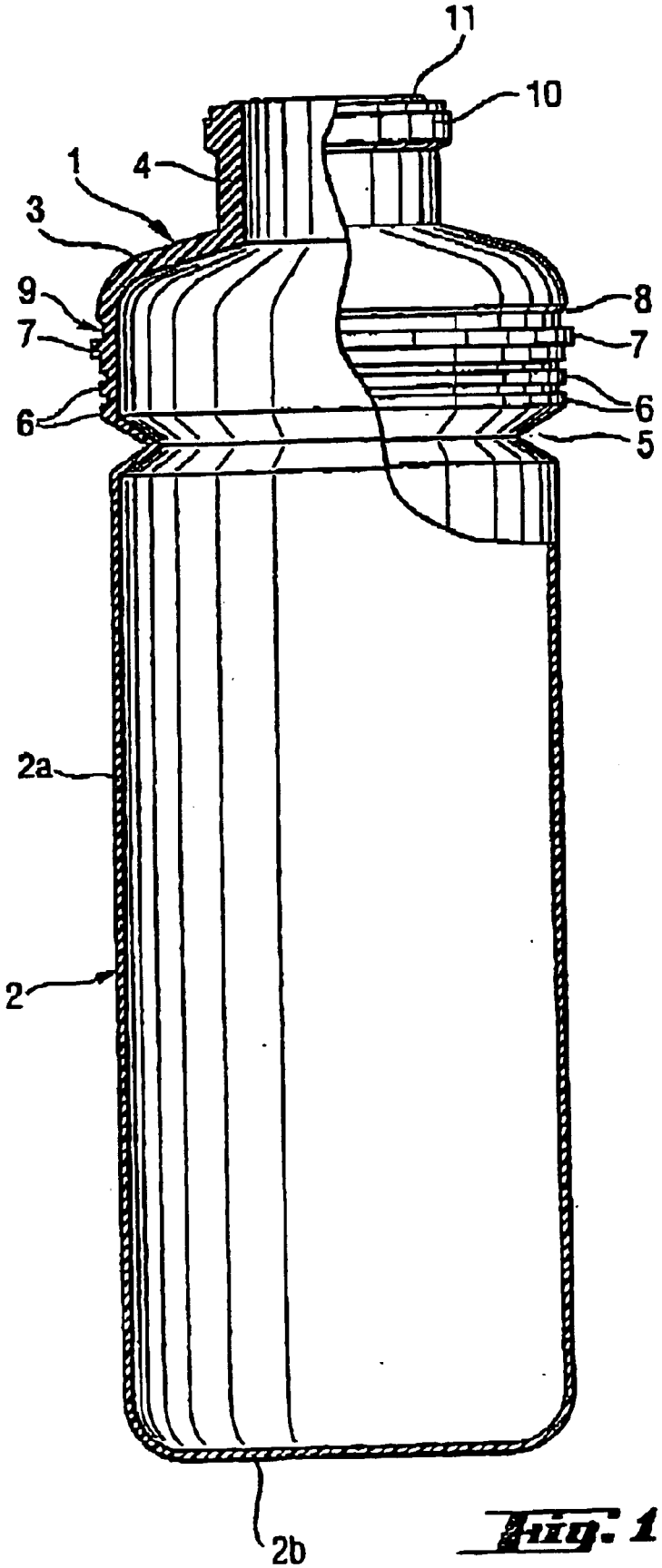

This invention concerns the packaging and dispensing of products of liquid to pasty consistency, such as cosmetics and dentifrices.

Such products are generally dispensing in dose form by hand pumps placed over the mouth of reservoirs containing those products, these pumps being activated by push buttons worked in alternating translation by the users finger in order to eject the product dose. These pumps come with axial piston moved by the nozzle and can extract the desired dose of product by means of the partial vacuum that the ascent of the piston creates in its internal chamber before its descent expels the dose.

It is increasingly desired for the products to remain constantly air-sealed in order to avoid their deterioration; the product reservoir then consists of a flexible bag protected inside an outer casing or housing, said housing being tightly connected usually to a centering ring of the pump body, inserted in the opening of the casing.

The corresponding pumps are advantageously pumps without air renewal, so that the product remains totally air-sealed even during dispensing of the doses. Very numerous pumps of this type and improvements in same have been proposed; in this regard one can mention among others the pumps according to international application WO 95/27569.

The interior bags have to be very resilient in order to ensure a correct dispensing operation. They are therefore made of a thin-walled flexible material. Under those conditions, they are set in place by being inserted at their neck portion on the ring or similar element forming part of the pump system. Once inserted, they are then tightly secured by gluing or by at least one weld line.

Those inserting and gluing or welding operations are very awkward in industrial manufacture. Furthermore, the ring receiving the neck of the deformable bag at its lower part must be long enough for the pump body not to be situated opposite said neck, for, on assembly, the parts of said pump body could be deformed upon those inserting, gluing or welding operations.

The present invention is intended to remedy those problems. For that purpose, it is arranged for the deformable bag to be made with a reinforced top part, which enables the bag to be attached to the device bearing the pump at said rigid part and, therefore, much more easily. The invention further offers the additional advantage that the bag, through its rigid part, can also be easily and directly integrated with the outer casing and, in particular, with a cover protecting the bag, a protective cap that can advantageously cooperate with the rigid part of said bag.

The invention therefore makes it possible to achieve substantial savings in the manufacture of those interior bag dispensers.

This invention therefore concerns, first of all, a bag provided with a deformable flexible wall, designed to contain a product of liquid to pasty consistency, which is intended to be dispensed by a manual jet metering pump of the type without air renewal, to be placed over an area of opening of said bag and to be arranged, in cooperation with the latter, to ensure that the product it contains is kept permanently air-sealed or appreciably air-sealed, said bag equipped with its pump furthermore to be able to be introduced and protected in an outer casing to form a packaging and dispensing unit for said product, characterized in that said bag presents, in proximity to its opening, at least one area rendered rigid by a thickening of its wall, and containing additional means of attachment that can be borne by said pump or by an element associated with same in the unit once it is assembled, and/or by the said outer casing when it is present, or by one or more parts of said casing.

The thickness of the bag in the flexible part is such that it can be removed upon use in combination with the pump without air renewal.

As explained above, the air renewal-free pump offers the best guarantee of preservation and conservation of the contents, particularly advantageous when they have to be kept sterile. The invention is thus of interest in the dispensing of sterile soap for hospital use or the like.

An additional advantage offered by the bag of the invention resides in the possibility of obtaining a dispensing of the contents in inverted position of the bag, that is, with the area of opening downward. This feature makes it easier to dispense the contents on a surface with complex relief or directed upward, in that it makes that dispensing possible by bringing the dispensing orifice closer to the surface.

In accordance with the invention, the use of said outer casing is optional. When that outer casing is absent, the outer surface of the bag itself can be decorated.

In particular, said bag is formed by extrusion-blow or injection-blow molding of a parison having a variable wall thickness depending on the profile sought for said bag. American patents U.S. Pat. No. 3,865,528 and U.S. Pat. No. 4,217,635 describe equipment which can be used to form those parisons. The latter are then adapted in an appropriate mold into which compressed air can be injected in order to apply the parison, which is expanded against the wall of the mold cavity, and to form the bag desired.

Said bag notably contains means of attachment of the pump or of an element associated with same by crimping, ratcheting, screwing, gluing or ultrasonic welding, and means of attachment of the casing or of one or more parts of same by ratcheting, screwing, gluing or ultrasonic welding.

In the event of presence of an outer casing, some of the methods of attachment of same to the bag, such as ratcheting or screwing, make it possible, after the bag has been emptied of its contents, to separate the bag and the casing. The latter is recoverable, which can given rise to a deposit system, already used in the recovery of some glass bottles, for example. This can result in a saving in overall production cost and in a gain in environmental protection.

In one particular embodiment of the bag according to the invention, this consists of a body containing a side wall closed at one end by a bottom and connected at its opposite end by means of a shoulder to a neck, the thickness of the wall of said bag being increased in the region of said neck, of said shoulder and of a part of said side wall adjacent to said shoulder.

The neck of the bag can have a continuous outer peripheral flange, under which at least one element holding in place the metering pump dispensing the product is intended to be coupled, notably by crimping or by ratcheting. That holding element is, in particular, a metal crimping collar or even a plastic collar connected by ratcheting or screwing.

As for the rigid part of the side wall of the bag, it can contain on the outside at least one ratchet ring designed to cooperate with an inner groove borne by the side wall of a cover in which the bag is intended to be inserted by its bottom or by its top and forming part of the outer protective casing of the bag.

Furthermore, the bag can advantageously be arranged to form, with the free edge of the cover in its assembly position, an annular groove for ratcheting of the lower part of a protective cap forming part of the outer casing.

According to one particular feature of the bag of the invention, the side wall of thereof contains a fold which is placed along a transverse plane of the bag and the profile of which is notably V-shaped, said fold being arranged so as to separate the rigid part and the flexible part of said bag. In this way, the rigid part of the bag is well secured as the flexible part of the bag is withdrawn upon use.

The bag according to the invention can be made of a single-layer material, such as polyethylene or propylene, or also of a multilayer material. As multilayer material, one can mention triple-layer materials containing an anhydrous outer barrier layer, for example of polyamide or ethylene-vinyl alcohol copolymer (EVOH), an intermediate binding layer and an inner layer, for example of polypropylene.

The outer layer can be made in any desired shape, with any desired material, such as glass or plastic or metal such as aluminum or tinplate.

This invention also concerns a packaging and dispensing unit for a product of liquid to pasty consistency, contained in a bag provided with a deformable flexible wall protected by an outer casing, a manual jet metering pump for said product, of the type without air renewal, being placed over an area of opening of said bag and being arranged, in cooperation with the latter, to ensure that the product it contains is kept air-sealed or appreciably air-sealed, characterized in that said bag is as defined above.

To better illustrate the subject of this invention, several particular embodiments are going to be described below, with reference to the attached drawings.

Figure 2:
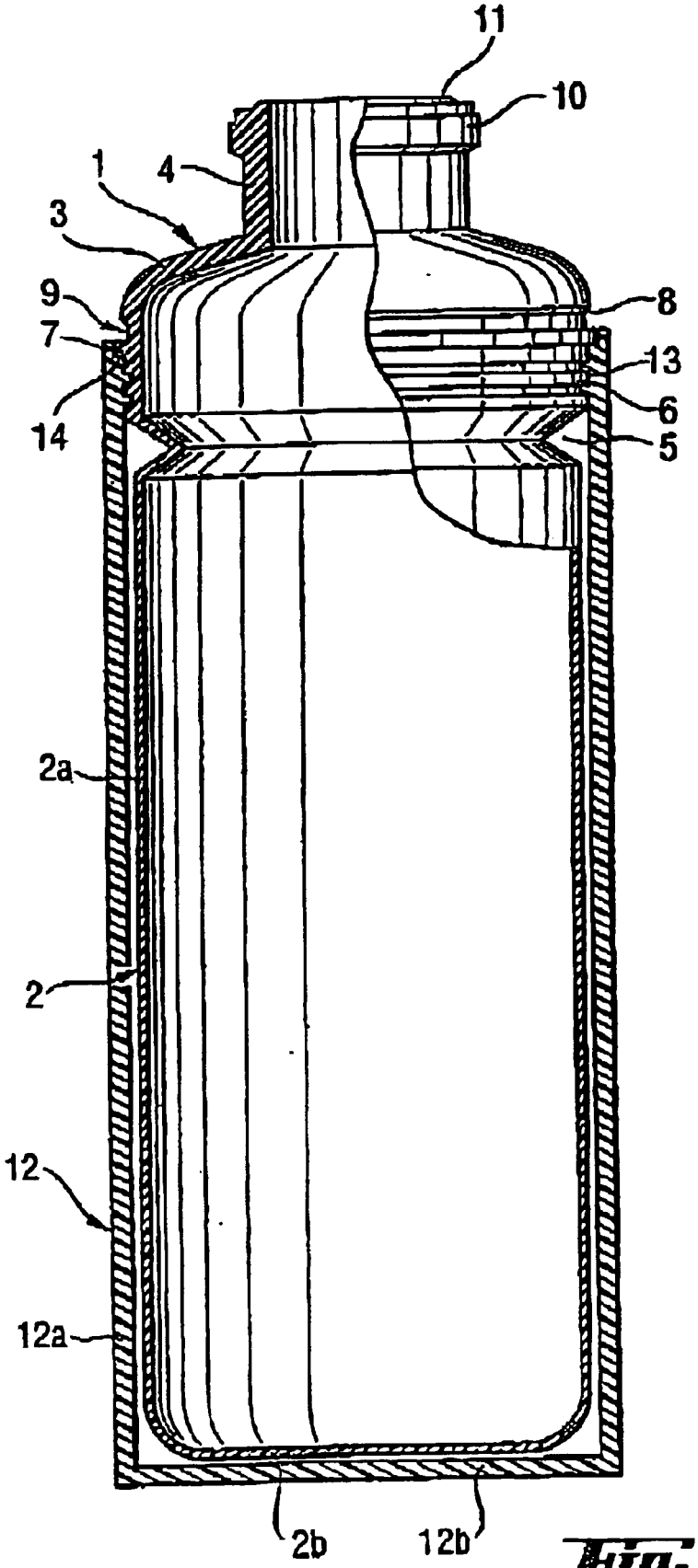
Figure 3:
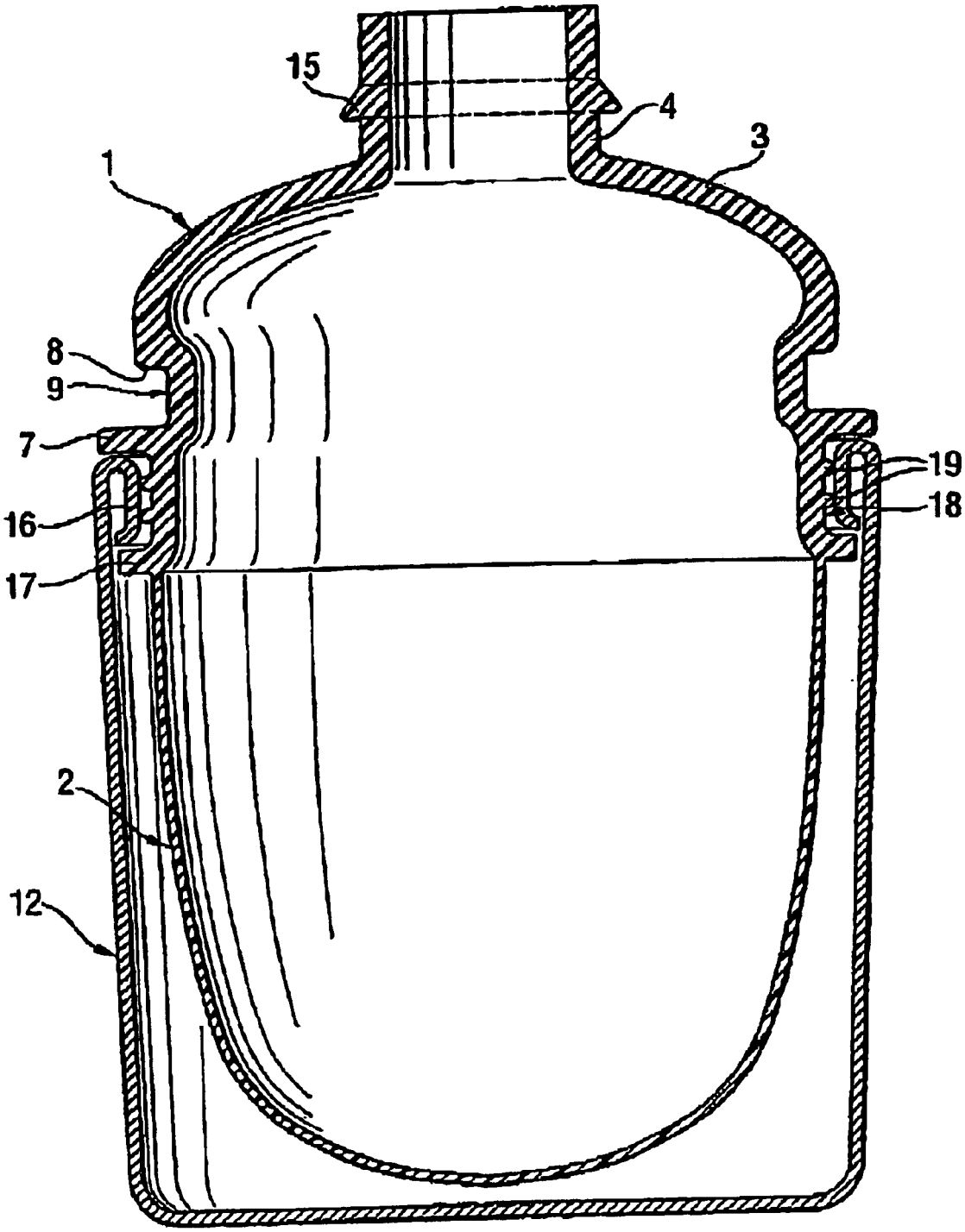

On those drawings:

FIG. 1 is a view in axial section of a bag according to one embodiment of this invention;

FIG. 2 is a view in axial section of the bag of FIG. 1 inserted in and integrated with the cover of an outer casing to form a packaging and dispensing unit according to the invention after a pump without air renewal has been mounted on the outlet of said bag and a protective cap covers the unit; and FIG. 3 is a partial view in axial section of a bag according to the invention, combined with an outer casing according to a particularly interesting embodiment.

Figure 4:
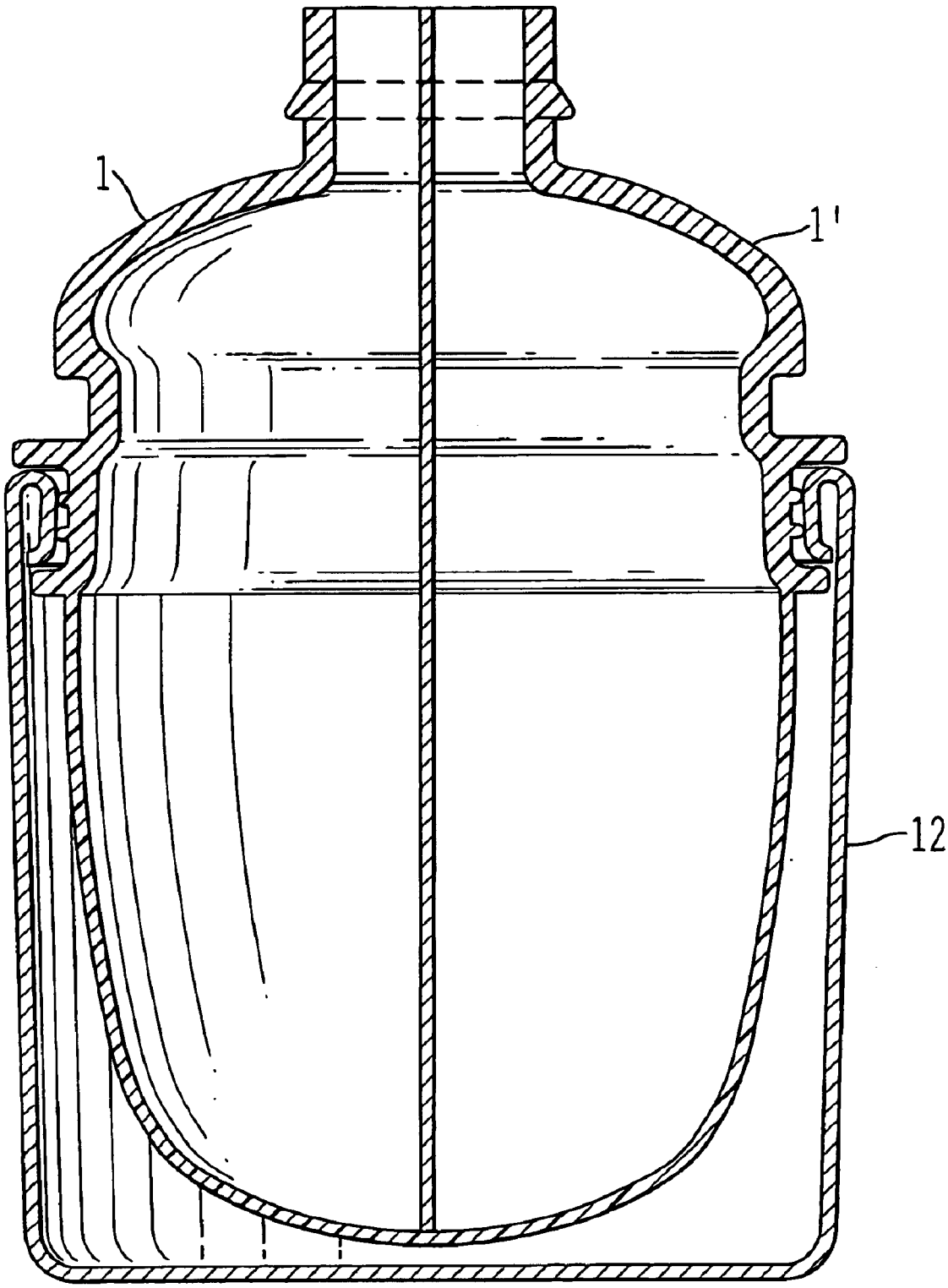

FIG. 4 is a view in axial section of a packaging and dispensing unit including first and second bags in a casing.

Referring to FIG. 1, it can be seen that 1 designates a bag designed to contain a product of liquid to pasty consistency, such as a beauty cream or dentifrice.

That bag 1 is made of polypropylene. It is molded by blow-extrusion of a parison, the thickness of which is varied along its wall in order to obtain, for said bag 1, a top part that is rigid by reason of its greater thickness, the rest of the bag having a flexible wall.

The bag 1 has a cylindrical body 2 containing a side wall 2*a* dosed at one end by a bottom 2*b* and connected, at its end opposite the bottom 2*b*, by means of a shoulder 3, to a neck 4.

In proximity to its end opposite the bottom 2*b*, the side wall 2*a* of the body 2 presents a fold 5 which is arranged in a radial section and which, in axial longitudinal section as represented on FIG. 1, has the shape of a V, the point of which is directed radially inward. That fold 5, which is formed in the thin part of the wall 2*a*, has the function of keeping the top of the bag 1 rigid when, in the course of use, it is forced to retract more and more as the product it contains is dispensed.

The rigid part of the wall 2*a* situated between the fold 5 and the shoulder 3 bears on the outside, going from the fold 5 to the shoulder 3, ratchet rings 6, a roughly square-sectioned flange 7 and then an outward separation 8 which creates, with the upper annular face of the flange 7, a groove 9, the function of which is indicated below.

As for the neck 4, it bears on the outside, in proximity to its upper edge, an annular flange 10 and on its upper edge an internal annular boss 11.

In the product packaging and dispensing unit which comprises the bag just described, a sealing washer is applied to the upper edge of the neck 4 cooperating with the annular boss 11. The washer is then held, for example, by a metal crimping collar which has an orifice in its center, permitting passage of the body of a so called lair renewal-free pump, which is tightly connected there. The crimping collar cooperates at its lower edge with the flange 10. The axial outlet tube of the pump forming part of the piston of that pump and projecting out of the said collar cooperates with a push button which contains a product dispensing nozzle. Such an assembly is well known, and there are others which are functionally equivalent.

On FIG. 2 it can be seen that the bag 1 is represented in place in the cover 12 constituting the body of an outer casing.

The cover 12, made by molding of a rigid plastic, contains a cylindrical side wall 12*a* connected to a flat bottom 12*b*. In proximity to its upper free edge, the side wall 12*a* bears grooves 13 intended to cooperate with the ratchet rings 6 borne by the rigid upper part of the bag 1. Above the grooves 13 the wall 12*a* presents an internal annular separation 14 intended to be applied, in mounting position, against the annular lower edge of the flange 7 of the bag 1. In that position, the upper free edge of the cover 12 is situated in the same radial plane as the upper edge of the flange 7.

A protective cap on the unit may be engaged in the groove 9, and its outer wall can be situated in the extension of the outer wall of the cover 12.

The bag and outer casing represented on FIG. 3 differ from those of FIG. 2.

The attachment to the bag 1 of an "air renewal-free" pump, not represented, will be simply obtained by driving in and ratcheting and possibly crimping of the pump on the neck 4, provided for that purpose with a peripheral protuberance 15 with right triangle section.

The body 2 of the bag 1 is not cylindrical here, but roughly ovoidal.

The cover 12 is aluminum here. It is distinguished by the fact that its upper edge presents an extra thickness 16 obtained by folding of the material toward the inside of the cylinder in a well known manner by means of sets of wheels. Prior to that operation, the hollow cylinder is formed, for example, by stamping in an also well known manner.

The bag 1 presents a flange 17 forming a groove 18 with flange 7.

The cover 12 is interlocked with the bag 1 by ratcheting, obtained with positioning of the extra thickness 16 inside the groove 18, the flanges 7 and 17 constituting stops for the extra thickness 16, once that positioning is carried out.

The bottom of the groove 18 presents flanges 19, the small size of which is chosen so that the extra thickness 16 is supported on the flanges 19 with the desired pressure.

This embodiment is particularly simple to use and its industrial application is also of interest from the economic standpoint.

It is well understood that the embodiments of this invention, as described above, have been given by way of nonlimitative example and that modifications can be introduced without departing from the scope of this invention. Thus, notably, the bag 1 and, in particular, its flexible and rectractable lower part, could take any desired shape, not necessarily cylindrical or ovoidal, the system for mounting the pump on the outlet opening of the bag 1 could be a system other than that described above, and the cover 12 could take any desired shape and be made of different materials, such as glass or metal other than aluminum.

On the other hand, one must also mention, as a particularly advantageous variant of the invention, a packaging and dispensing unit for a product of liquid to pasty consistency, as shown in FIG. 4, obtained by mixing of at least two components contained in separate bags (e.g. a first bag 1 and a second bag 1') provided with a deformable flexible wall protected by the cover 12 of an outer casing, a manual jet metering pump for said product, of the type without air renewal, being placed over an area of opening of each of the bags and being arranged, in cooperation with the latter, to ensure that the product they contain is kept air-sealed or appreciably air-sealed, characterized in that each of said bags is as defined above. The feature according to which the manual metering pump is placed over an area of opening of each of the bags relates to the fact that the interior volume of the bags connects with any device capable of pumping the components of the product of liquid to pasty consistency and then of mixing them under pressures and in proportions that are appropriate; in some cases, that device may comprise separate pumping means for the different components.

What is claimed is:

1. Bag adapted to contain a product of liquid to pasty consistency, which is intended to be dispensed by a manual jet metering pump of the type without air renewal to be placed over an area of opening of said bag and to be arranged to ensure that the product is kept permanently air-sealed or appreciably air-sealed, the bag comprising:

a wall comprising a first portion and a second portion, the second portion having a thickness greater than the first portion and having means for attaching to the pump, means for attaching to a casing for surrounding the bag, and means for attaching to a cap for covering the pump, the means for attaching to the cap comprising a groove disposed on an exterior of the second portion between the means for attaching to the pump and the means for attaching to the casing.

2. Bag according to claim 1, wherein the wall is formed by extrusion-blow or injection-blow molding of a parison.

3. Bag according to claim 1, wherein the means for attaching to the pump is adapted to attach to the pump by crimping, ratcheting, screwing, gluing or ultrasonic welding.

4. Bag according to claim 1, wherein the first portion comprises a side wall closed at one end by a bottom, and the second portion comprises a shoulder connected to the first portion and a neck.

5. Bag according to claim 4, wherein the neck has a continuous outer peripheral flange adapted to receive a coupling element to connect the pump and the bag.

6. Bag according to claim 4, whereon the second portion comprises at least one ratchet ring adapted to cooperate with a groove of a side wall of a cover to surround the bag.

7. Bag according to claim 4, wherein the first portion comprises a fold having a V-shaped profile, said fold separating the first and second portions of said bag.

8. Bag according to claim 1, wherein one of the first and second portions comprises a single-layer or multilayer material.

9. Packaging and dispensing unit comprising:

a casing; and a bag adapted to contain a product of liquid to pasty consistency intended to be dispensed by a manual jet metering pump of the type without air renewal, the bag comprising a wall including a first portion and a second portion, the second portion having a thickness greater than the first portion and having means for attaching to the pump, means for attaching to the casing for surrounding the bag, and means for attaching to a cap for covering the pump, the means for attaching to the cap comprising a groove disposed on an exterior of the second portion between the means for attaching to the pump and the means for attaching to the casing.

10. Packaging and dispensing unit comprising:

a casing;

a first bag adapted to contain a product of liquid to pasty consistency intended to be dispensed by a manual jet metering pump of the type without air renewal, the bag comprising a wall including a first portion and a second portion, the second portion having a thickness greater than the first portion and having means for attaching to the pump, means for attaching to a casing for surrounding the bag, and means for attaching to a cap for covering the pump, the means for attaching to the cap comprising a groove disposed on an exterior of the second portion between the means for attaching to the pump and the means for attaching to the casing; and a second bag.

11. A bag adapted to contain a product of liquid or pasty consistency, comprising:

a first body portion having a first thickness, the first body portion comprising a folded portion adapted to retract during a dispensation of the product from the bag;

a second body portion disposed adjacent the first body portion and having a second thickness that is greater than the first thickness, the second body portion comprising:

an annular portion adapted to releasably retain a cover for surrounding the bag;

a neck portion adapted to retain a pump; and a shoulder portion disposed between the annular portion and the neck portion, the shoulder portion including a groove disposed on an exterior of the shoulder portion adapted to releasably retain a cap for covering the pump.

12. The bag according to claim 11, wherein the annular portion comprises a ratchet ring adapted to cooperate with a corresponding ring of the cover.

13. The bag according to claim 11, wherein the annular portion comprises a flange adapted to cooperate with an end portion of the cover.

14. The bag according to claim 11, wherein the neck portion comprises an annular flange.

15. The bag according to claim 11, wherein the neck portion comprises a boss disposed in an interior opening of the neck portion.

* * * * *